US012264424B2

(12) United States Patent
Thorén et al.

(10) Patent No.: US 12,264,424 B2
(45) Date of Patent: Apr. 1, 2025

(54) SEWING WORKPIECE HOLDERS FOR SEWING MACHINES AND ASSOCIATED METHODS

(71) Applicant: Singer Sourcing Limited LLC, Lavergne, TN (US)

(72) Inventors: Sara Nandani Josephine Thorén, Jönköping (SE); Stina Sara Magdalena Petersson, Jönköping (SE)

(73) Assignee: Singer Sourcing Limited LLC, Nashville, TN (US)

( * ) Notice: Subject to any disclaimer, the term of this patent is extended or adjusted under 35 U.S.C. 154(b) by 0 days.

(21) Appl. No.: 18/235,374

(22) Filed: Aug. 18, 2023

(65) Prior Publication Data

US 2025/0059692 A1 Feb. 20, 2025

(51) Int. Cl.

| | |
|---|---|
| ***D05C 5/02*** | (2006.01) |
| ***D05B 3/24*** | (2006.01) |
| ***D05B 39/00*** | (2006.01) |
| ***D05C 9/04*** | (2006.01) |

(52) U.S. Cl.

CPC ..... *D05C 9/04* (2013.01); *D05B 3/243* (2013.01); *D05B 39/00* (2013.01); *D05C 5/02* (2013.01)

(58) Field of Classification Search

CPC ... D05C 9/04; D05C 9/00; D05C 5/00; D05B 3/243; D05B 39/00; D05B 39/005

See application file for complete search history.

(56) References Cited

U.S. PATENT DOCUMENTS 3,664,288 A * 5/1972 Weidlin Von Boden ..... D05C 9/04 112/103
5,144,899 A * 9/1992 Allen ..... D06P 5/001 428/906.6
5,353,725 A * 10/1994 Sakakibara ..... D05C 9/04 112/470.14
6,237,516 B1 * 5/2001 Wakayama ..... D05B 19/105 112/102.5
6,298,800 B1 10/2001 Gala (Continued)

FOREIGN PATENT DOCUMENTS

GB 2309231 A * 7/1997 ..... D05C 1/02

OTHER PUBLICATIONS

PCT Search Report and Written Opinion dated Sep. 25, 2024 for corresponding PCT International Application No. PCT/US2024/036978.

*Primary Examiner* — Ismael Izaguirre
(74) *Attorney, Agent, or Firm* — Olive Law Group, PLLC

(57) ABSTRACT

Sewing workpiece holders for sewing machines and associated methods are disclosed herein. According to an aspect, a sewing workpiece holder includes a first frame that defines an opening. A second frame defines an opening. The second frame is configured to attach to the first frame and to hold a sewing workpiece therebetween. The openings of the first frame and the second frame substantially align when the second frame is attached to the first frame such that a portion of the sewing workpiece is exposed within the aligned openings when the sewing workpiece is held. A first bracket is attached to a first side of the first frame or the second frame. The first bracket is attachable to the sewing embroidery machine. A second bracket is attached to a second side of the first frame or the second frame. The second bracket is attachable to the sewing embroidery machine.

26 Claims, 10 Drawing Sheets

(56) References Cited

U.S. PATENT DOCUMENTS

| | | | | |
|---|---|---|---|---|
| 6,336,416 | B1 * | 1/2002 | French | D05C 9/04 112/103 |
| 7,506,596 | B2 * | 3/2009 | Bowlus | D05B 39/00 38/102.2 |
| 8,245,654 | B2 | 8/2012 | Konig et al. | |
| 8,561,560 | B2 | 10/2013 | Kawaguchi et al. | |
| 9,617,670 | B2 | 4/2017 | Katano et al. | |
| 2020/0024783 | A1 | 1/2020 | Ueda et al. | |

* cited by examiner

SEWING WORKPIECE HOLDERS FOR SEWING MACHINES AND ASSOCIATED METHODS

TECHNICAL FIELD

The presently disclosed subject matter relates generally to sewing machines. Particularly, the presently disclosed subject matter relates to sewing workpiece holders for sewing machines and associated methods.

BACKGROUND

Sewing machines are well-known devices for sewing fabric and other materials together with thread. One common technique or craft with sewing is embroidery. This involves decorating fabric or other material using a needle to apply thread or yarn. Sewing machines can utilize an embroidery machine for assisting with embroidery. Embroidery machines or units can be programmed with a set of instructions for controlling the sewing machine to stitch a particular pattern or design on fabric.

Embroidery machines typically include embroidery hoops, also called embroidery frames, for holding and guiding fabric to be embroidered. The hoop is usually clamped to the fabric so that the fabric is held in tension. It is important that the fabric be held securely in place with respect to the sewing machine needle during embroidery so that fine design patterns are accurately sewn.

In some instances, fabric is embroidered on both sides. For example, felting embroidery is a technique for wool and involves embroidery on both sides of the material. In another example, bobbin work is an embroidery technique which is useful for being able to embroider on both sides of the fabric. These and other techniques involve releasing and re-attaching the fabric to the hoop when changing from one side to the other. These steps can be time consuming and include a risk of misalignment. Accordingly, there is a need for improved embroidery techniques and equipment for addressing this issue.

BRIEF DESCRIPTION OF THE DRAWINGS

Figure 1:
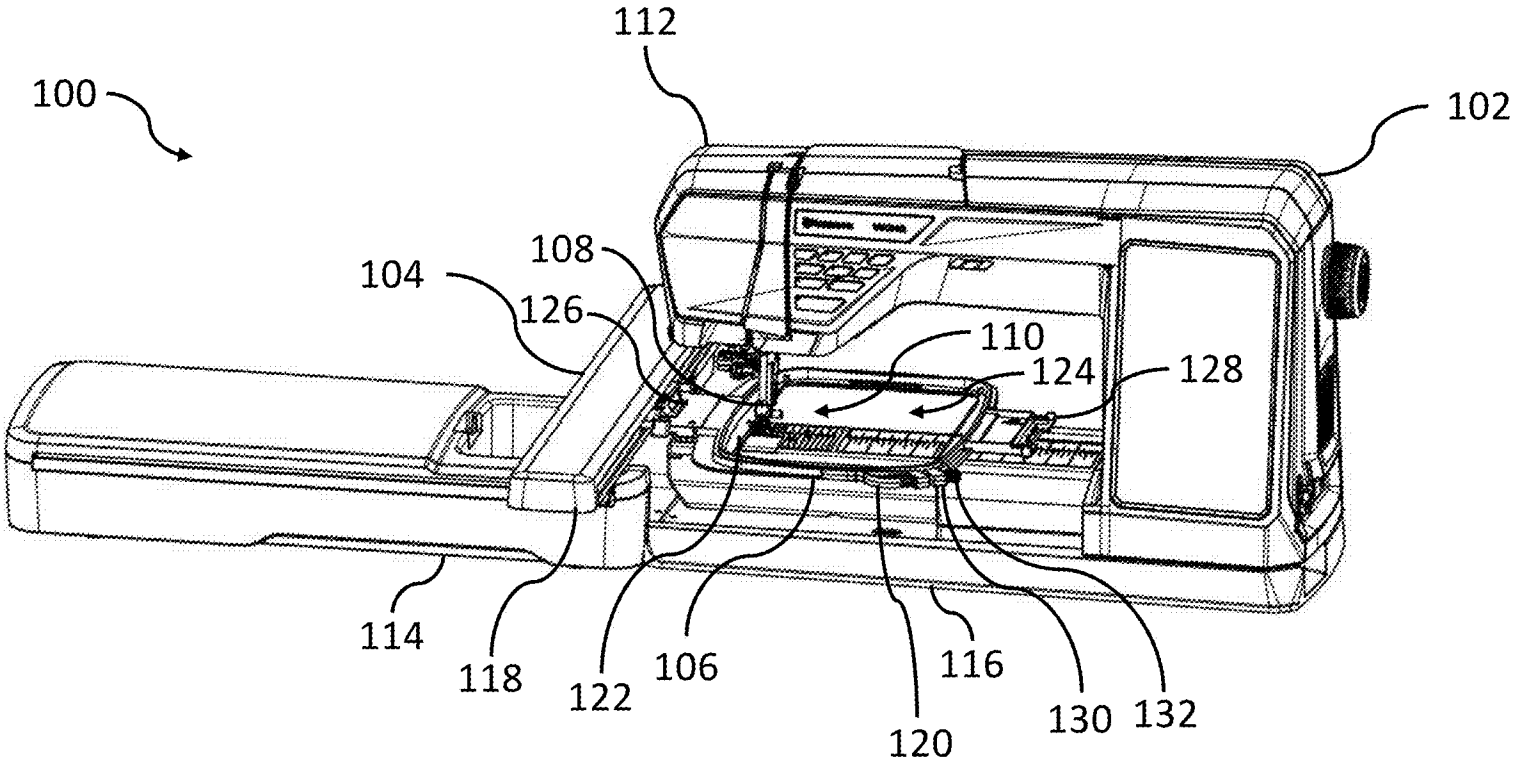
Figure 2:
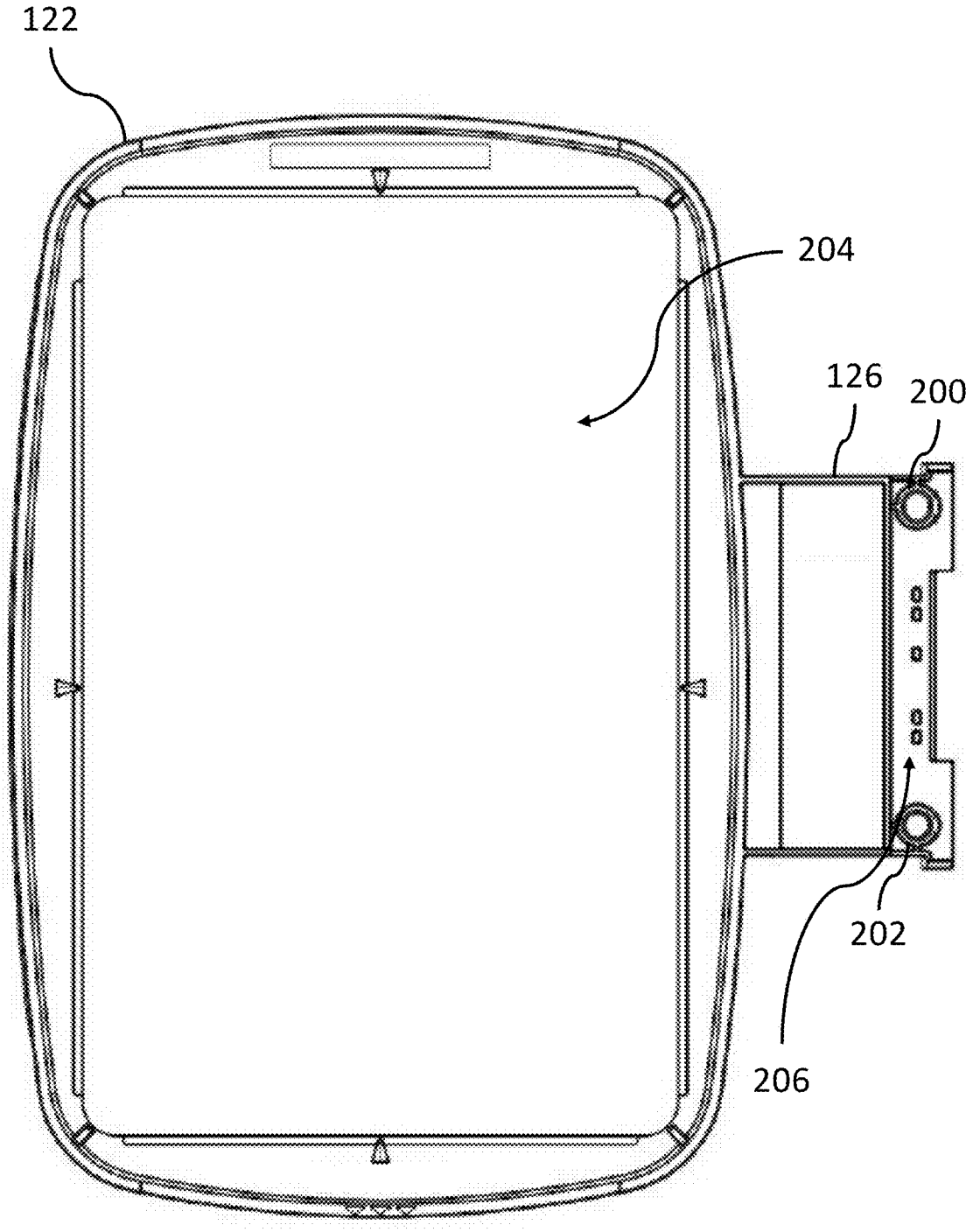
Figure 3:
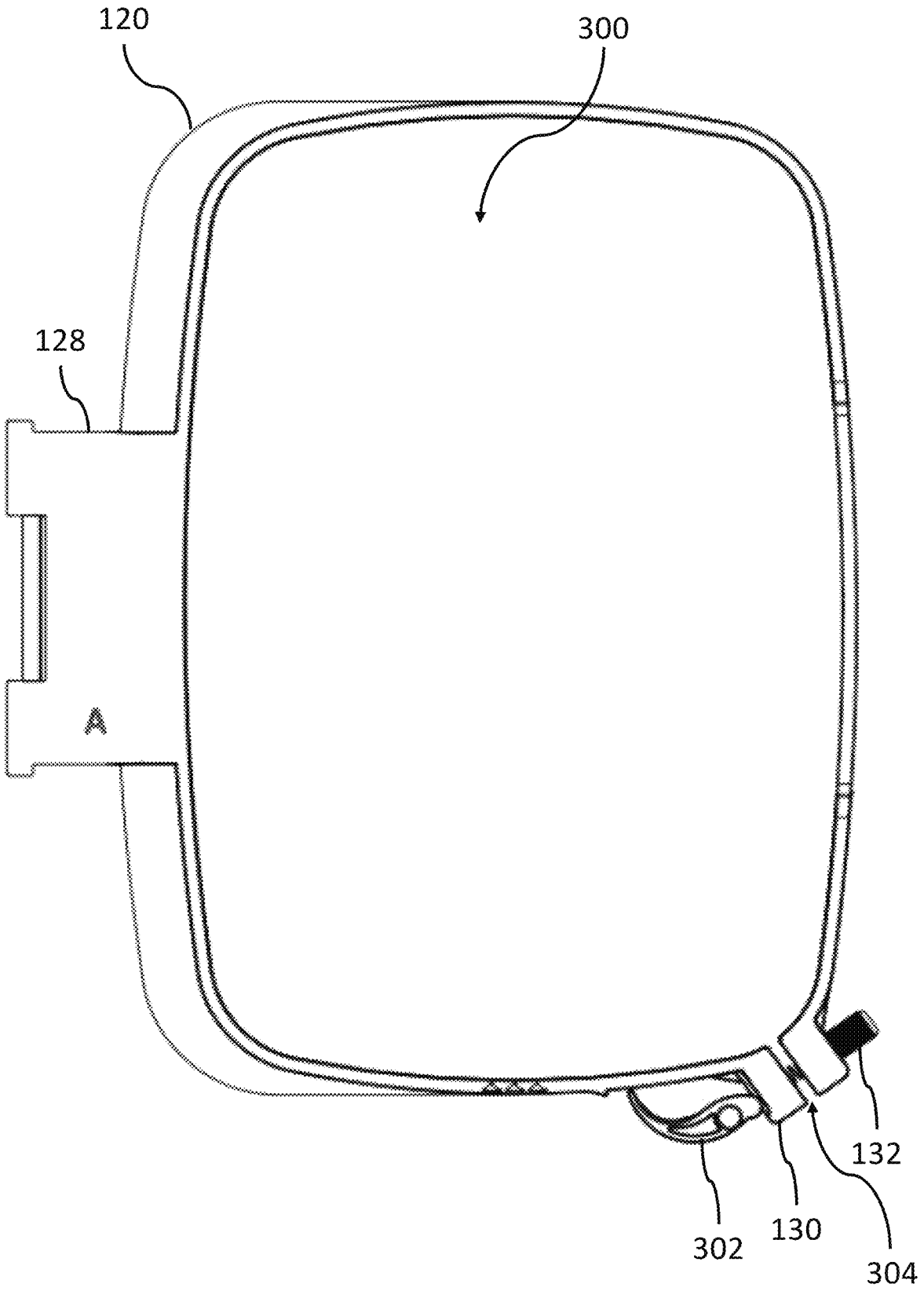
Figure 4:
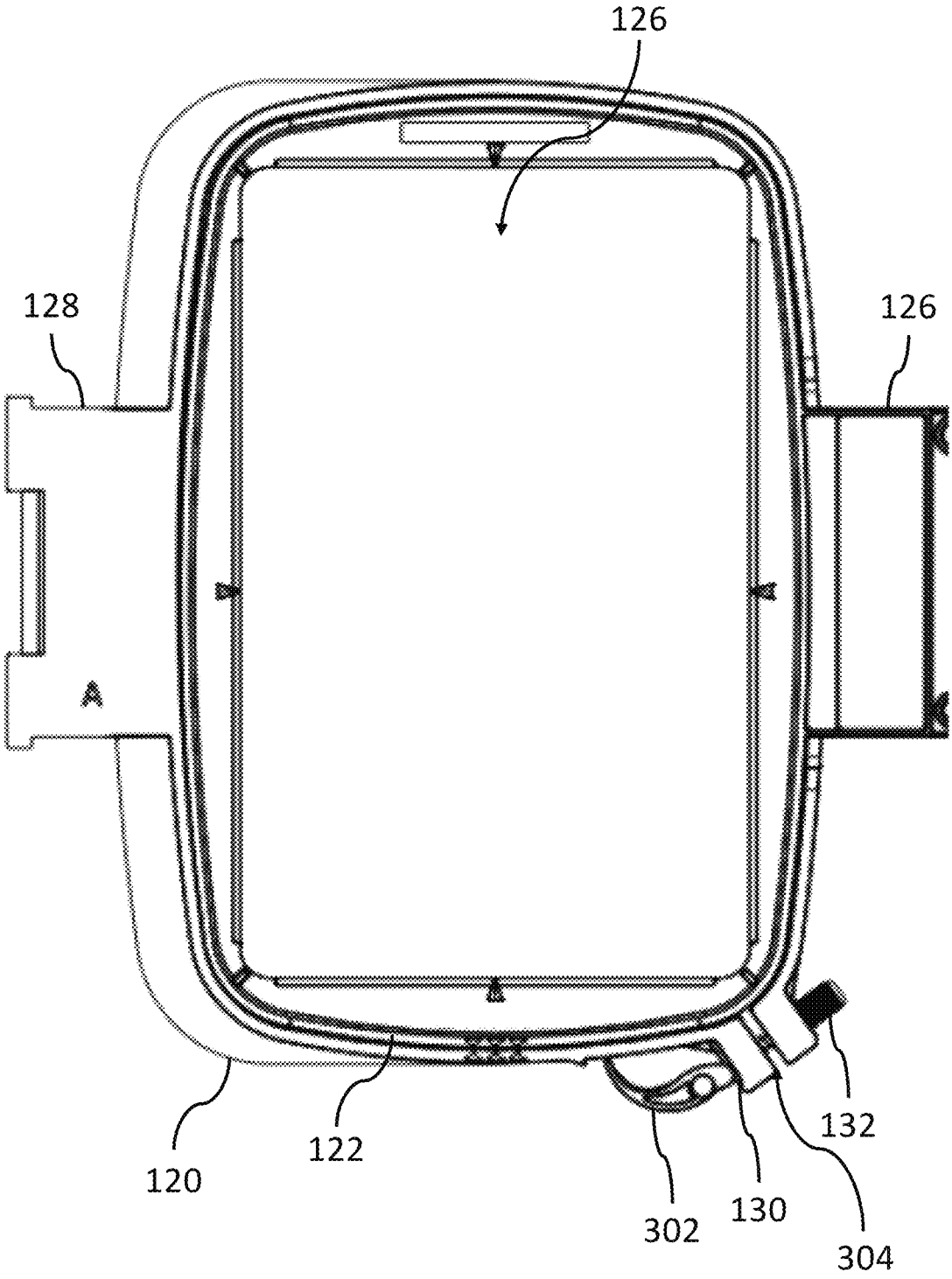
Figure 5:
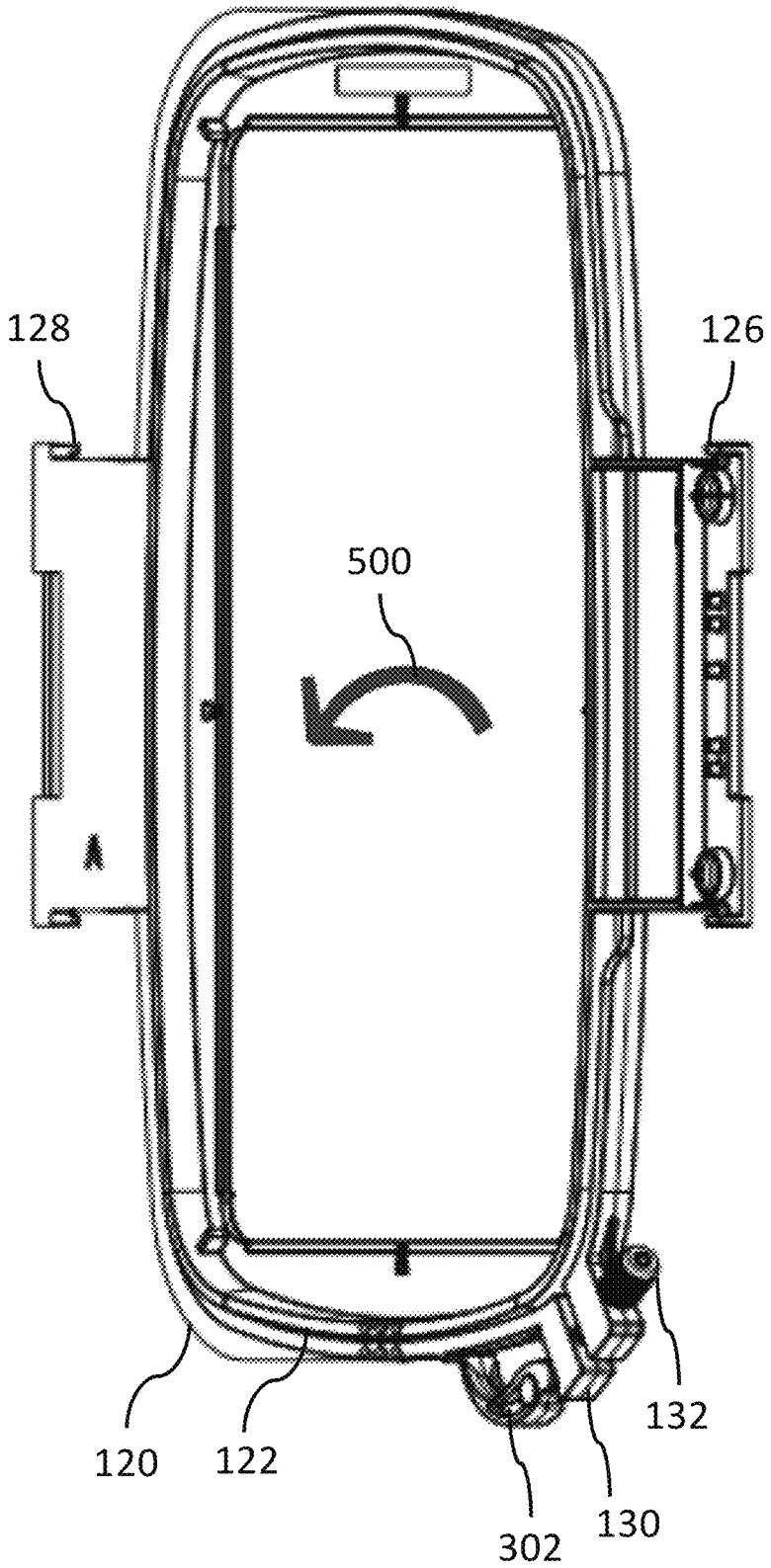
Figure 6:
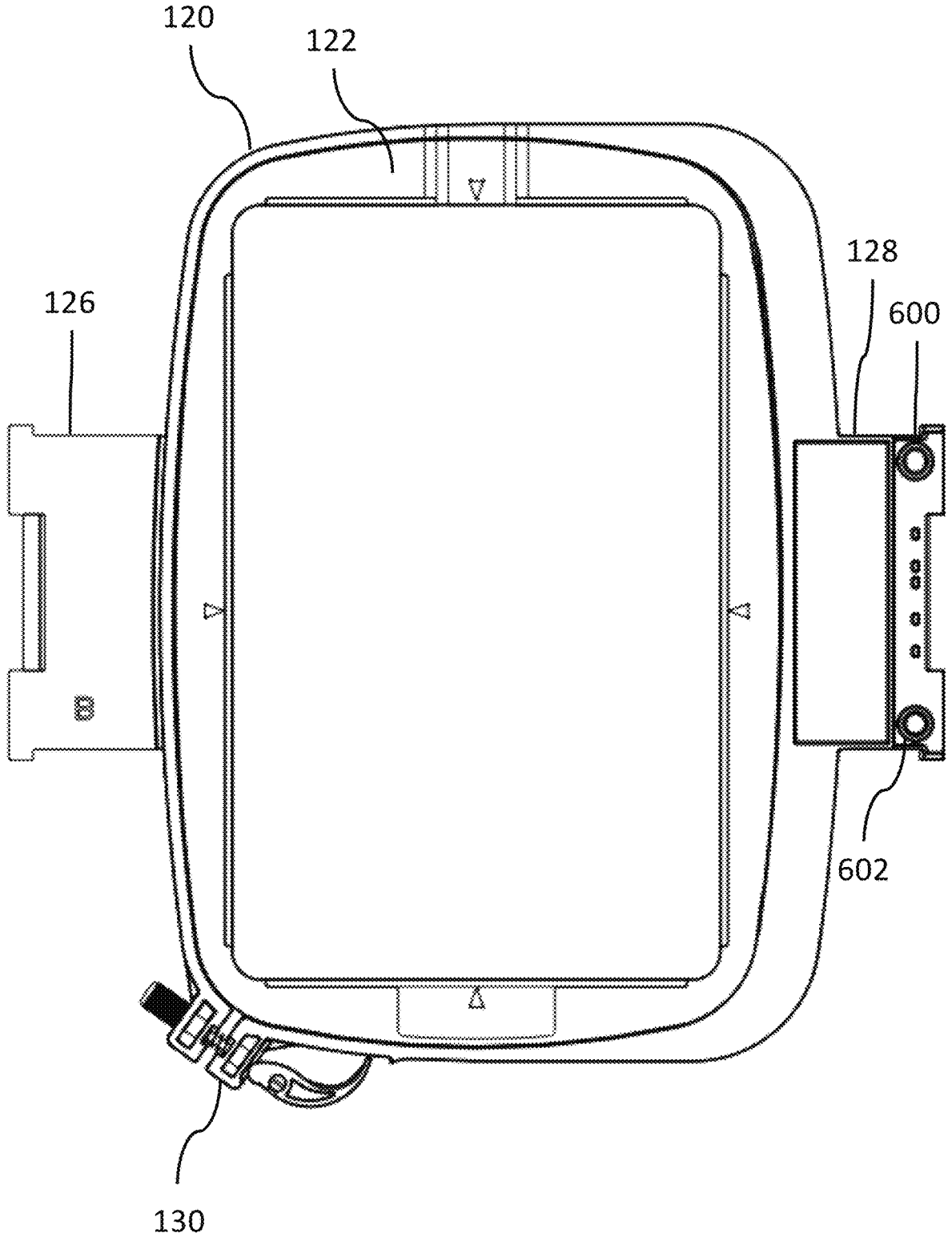
Figure 7:
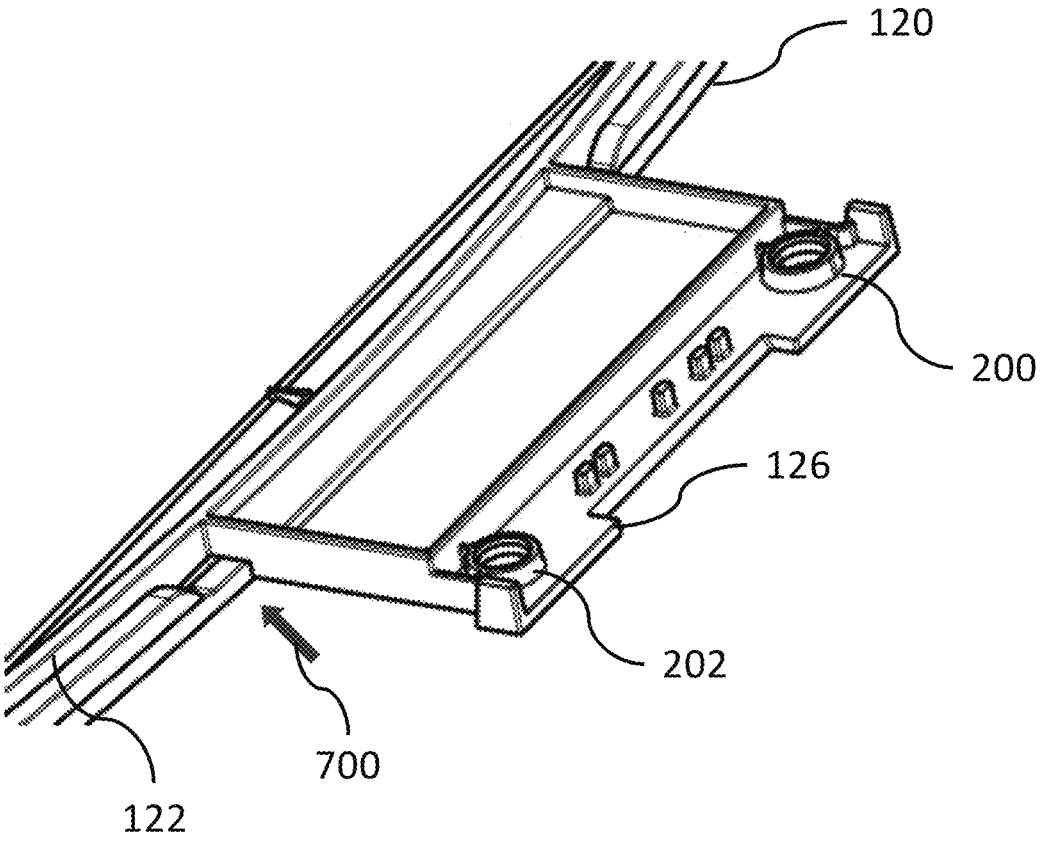
Figure 8:
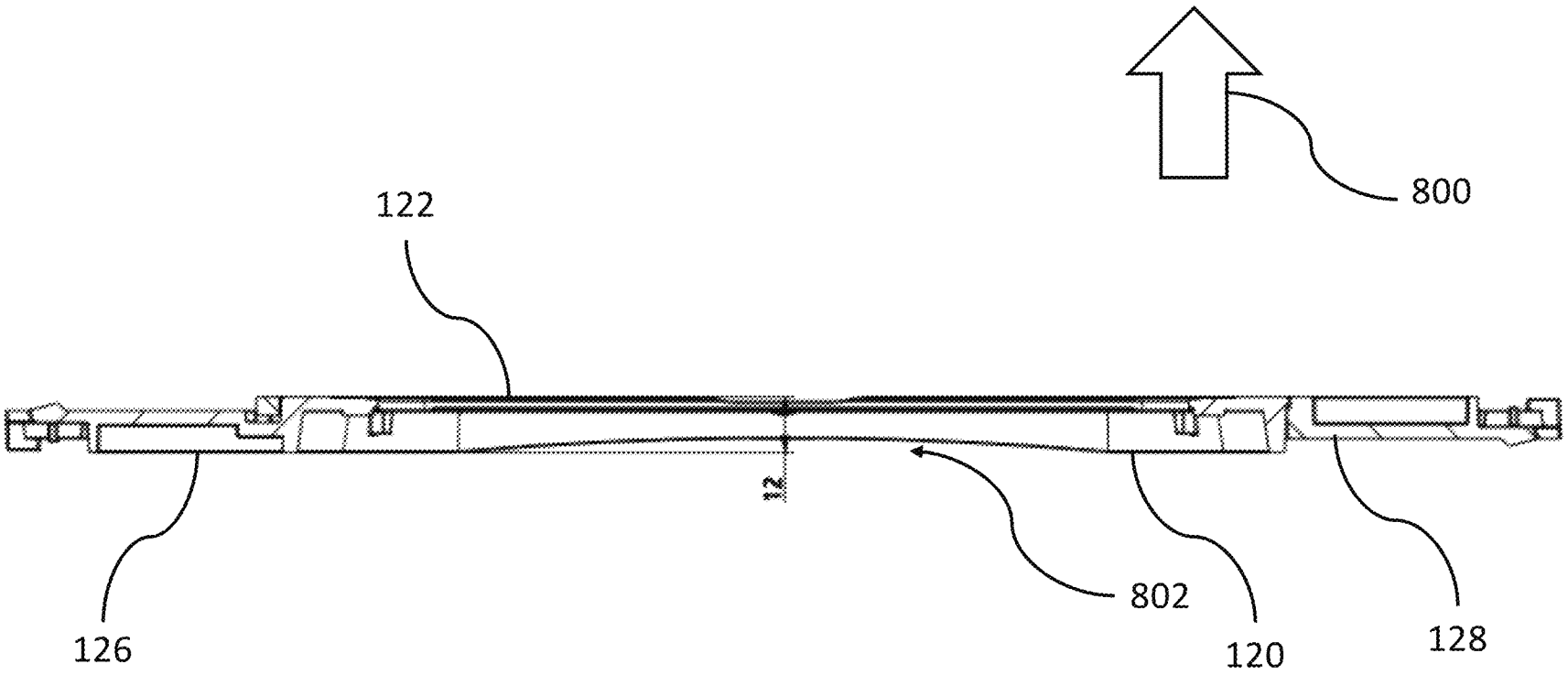
Figure 9:
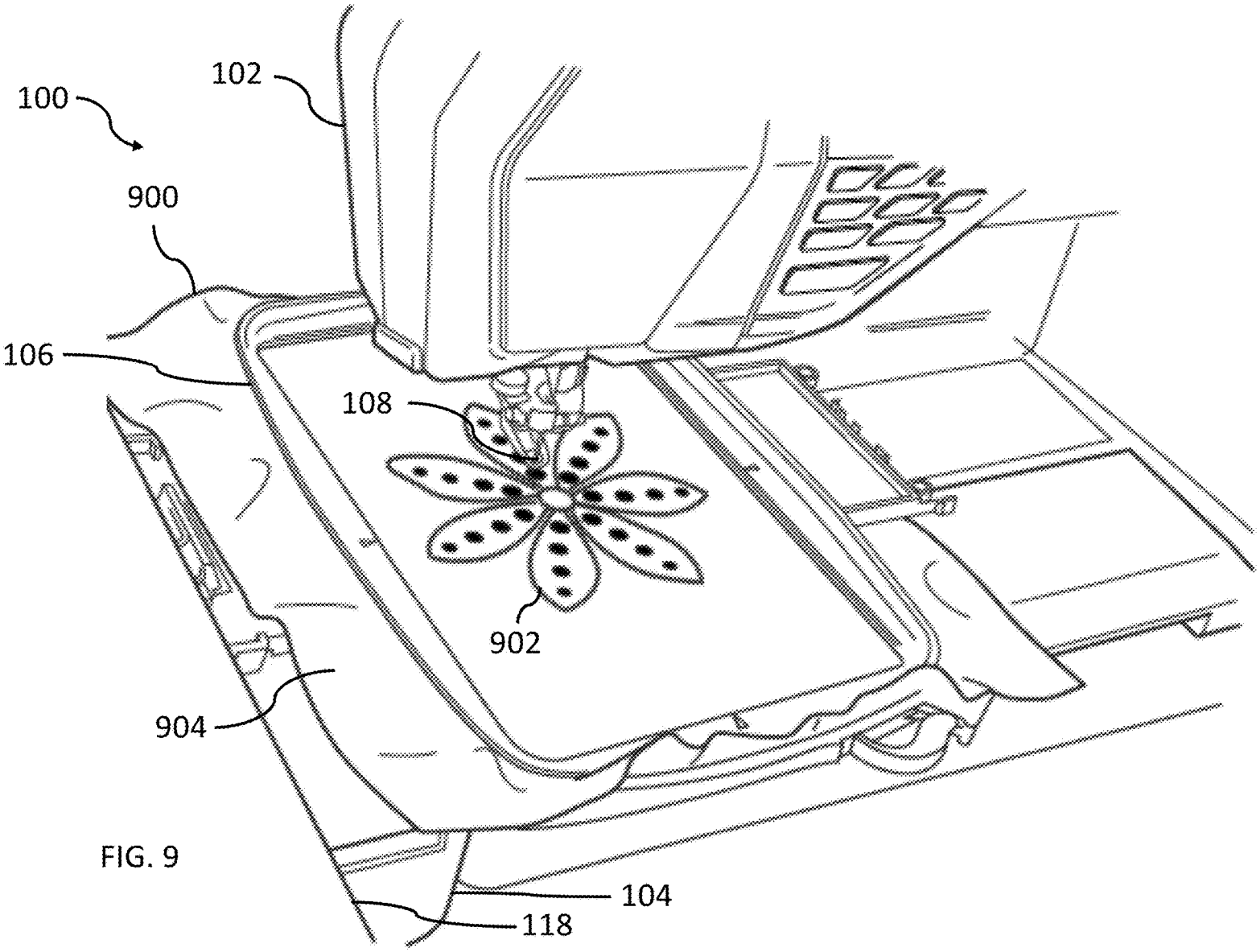
Figure 10:
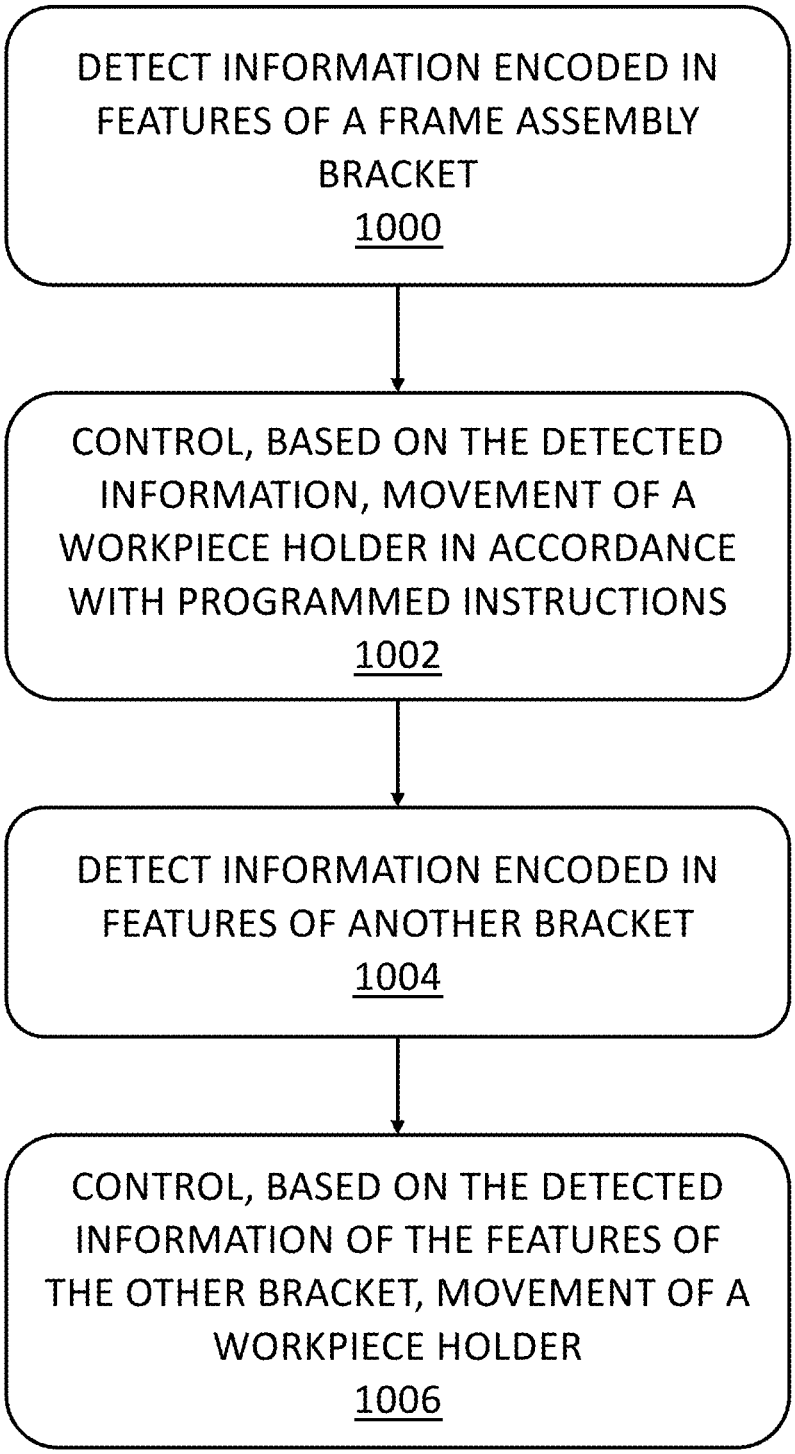

Having thus described the presently disclosed subject matter in general terms, reference will now be made to the accompanying Drawings, which are not necessarily drawn to scale, and wherein:

FIG. 1 is a perspective view of a sewing system including a sewing machine, an embroidery machine, and workpiece holder for embroidering in accordance with embodiments of the present disclosure;

FIG. 2 is a top view of the inner frame of the workpiece holder shown in FIG. 1;

FIG. 3 is a top view of the outer frame of the workpiece holder shown in FIG. 1;

FIG. 4 is a top view of the outer frame and the inner frame attached together in accordance with embodiments of the present disclosure;

FIG. 5 is a top view of the outer frame and the inner frame along with an arrow depicting the motion needed to move the frame assembly one bracket is detached and subsequently the bracket is attached to the mechanism of the embroidery machine;

FIG. 6 is an opposing view of the view of the outer frame and the inner frame shown in FIG. 4;

FIG. 7 is a close, perspective view of the outer frame and the inner frame;

FIG. 8 is a side view of the outer frame and the inner frame;

FIG. 9 is a perspective view of the sewing system shown in FIG. 1 during operation for embroidering fabric in accordance with embodiment of the present disclosure; and FIG. 10 illustrates a flow diagram of an example method of use of features of a frame assembly bracket by a sewing embroidery machine in accordance with embodiments of the present disclosure.

SUMMARY

The presently disclosed subject matter relates to sewing workpiece holders for sewing machines and associated methods. According to an aspect, a sewing workpiece holder includes a first frame that defines an opening. The sewing workpiece holder also includes a second frame that defines an opening. The second frame is configured to attach to the first frame and to hold a sewing workpiece therebetween. The openings of the first frame and the second frame substantially align when the second frame is attached to the first frame such that a portion of the sewing workpiece is exposed within the aligned openings when the sewing workpiece is held. The working workpiece holder also includes a first bracket attached to a first side of the first frame or the second frame. The first bracket is attachable to the sewing embroidery machine. Further, the working workpiece holder includes a second bracket attached to a second side of the first frame or the second frame. The second bracket is attachable to the sewing embroidery machine.

According to another aspect, the sewing workpiece comprises fabric, felt, or wool.

In another aspect, the first frame and the second frame are substantially rectangular in shape.

In another aspect, the first bracket and the second bracket are releasably attachable to the sewing embroidery machine.

In another aspect, the first bracket is attachable to the sewing embroidery machine when positioned in a first orientation. The second bracket is attachable to the sewing embroidery machine when positioned in a second orientation that is different than the first orientation.

In another aspect, in the first orientation, a first side of the sewing workpiece is directed in a direction towards a working part of a sewing machine attached to the sewing embroidery machine. In the second orientation, a second side of the sewing workpiece is directed in the direction towards the working part of the sewing machine.

In another aspect, the direction is substantially upward.

In another aspect, the working part of the sewing machine is a sewing needle.

In another aspect, the first side of the first frame or the second frame substantially opposes the second side of the first frame or the second frame.

In another aspect, the first bracket is attached to the first frame, and wherein the second bracket is attached to the second frame.

In another aspect, the sewing workpiece holder comprises a clamp for attaching the first frame to the second frame.

In another aspect, the first bracket is attached to the first side of the first frame. The second frame defines an indentation that is located adjacent to the first bracket when the first and second frames are attached such that a portion of the sewing workpiece fits in the indentation when the sewing workpiece is being held between the first frame and the second frame.

In another aspect, the indentation extends along the second frame a distance greater than a width of the first bracket.

In another aspect, the first and/or second bracket comprises one or more identification elements that may actuate an identification means on the corresponding connection portion of the sewing machine.

In another aspect, the identification elements are configured to indicate the type and size of the embroidery frame.

In another aspect, the identification elements are configured to determine if either the first or second bracket is connected to the sewing machine. The effect of this is that the machine can determine which side of the fabric is currently embroidering.

In embodiments, the identification means on the sewing machines is at least one electrical switch. The switch may be activated or inactivated by the identification elements, which may be in the form of actuator pins on the first and/or second bracket of the embroidery frame. One or more switches may be actuated according to a predetermined order as indicated by the identification elements.

According to another aspect, a sewing system includes a sewing machine including a working part for sewing a workpiece. The system also includes a sewing embroidery machine attached to the sewing machine for cooperatively operating with the sewing machine to embroider the workpiece. Further, the system includes a workpiece holder comprising a first frame that defines an opening. The workpiece holder also includes a second frame that defines an opening. The second frame is configured to attach to the first frame and to hold the workpiece therebetween. The openings of the first frame and the second frame substantially align when the second frame is attached to the first frame such that a portion of the sewing workpiece is exposed for embroidery within the aligned openings when the workpiece is held. The workpiece holder also includes a first bracket attached to a first side of the first frame or the second frame. The first bracket being attachable to the sewing embroidery machine. Further, the workpiece holder includes a second bracket attached to a second side of the first frame or the second frame. The second bracket is attachable to the sewing embroidery machine.

According to another aspect, a method for embroidery includes placing a sewing workpiece between a first frame and a second frame of a sewing workpiece holder. The first and second frames define an opening when attached together for exposing a portion of the sewing workpiece. The sewing workpiece holder comprises a first bracket and a second bracket. The first bracket is attached to a first side of the first frame or the second frame. The second bracket is attached to a second side of the first frame or the second frame. Further, the method includes attaching the first bracket to a sewing embroidery machine for orienting a first side of the sewing workpiece in a direction towards a working part of a sewing machine attached to the sewing embroidery machine. The method also includes detaching the first bracket from the sewing embroidery machine. Further, the method includes attaching the second bracket to the sewing embroidery machine for orienting a second side of the sewing workpiece in a direction towards the working part of a sewing machine.

In another aspect, the first bracket and the second bracket are releasably attachable to the sewing embroidery machine.

In another aspect, the first bracket is attachable to the sewing embroidery machine when positioned in a first orientation. The second bracket is attachable to the sewing embroidery machine when positioned in a second orientation that is different than the first orientation.

In another aspect, in the first orientation, a first side of the sewing workpiece is directed in a direction towards a working part of a sewing machine attached to the sewing embroidery machine. In the second orientation, a second side of the sewing workpiece is directed in the direction towards the working part of the sewing machine.

In another aspect, the working part of the sewing machine is a sewing needle.

In another aspect, the first side of the first frame or the second frame substantially opposes the second side of the first frame or the second frame.

According to an aspect, a sewing workpiece holder for a sewing embroidery machine includes a frame assembly configured to hold a sewing workpiece. The frame assembly defines an opening for exposing a portion of the sewing workpiece when the sewing workpiece is held. The sewing workpiece holder also includes a first bracket attached to a first side of the frame assembly. The first bracket is attachable to the sewing embroidery machine. Further, the sewing workpiece holder includes a second bracket attached to a second side of the first frame or the second frame. The second bracket is attachable to the sewing embroidery machine. The second bracket defines at least one feature configured to interface with the sewing embroidery machine and to indicate to the sewing embroidery machine when the second bracket is attached to the sewing embroidery machine.

In another aspect, the at least one feature is shaped, positioned, and/or sized to indicate information for the sewing embroidery machine to identify a size and/or type of the frame assembly.

In another aspect, the at least one feature is shaped, positioned, and/or sized to indicate information for the sewing embroidery machine to identify a side of the sewing workpiece positioned towards a working part of a sewing machine.

In another aspect, the first bracket defines at least one feature configured to interface with the sewing embroidery machine and to indicate to the sewing embroidery machine when the first bracket is attached to the sewing embroidery machine.

In another aspect, the at least one feature of the first bracket is shaped, positioned, and/or sized to indicate information for the sewing embroidery machine to identify a size and/or type of the frame assembly.

In another aspect, the at least one feature of the first bracket is shaped, positioned, and/or sized to indicate information for the sewing embroidery machine to identify a side of the sewing workpiece positioned towards a working part of a sewing machine.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Unless otherwise defined, all technical terms used herein have the same meaning as commonly understood by one of ordinary skill in the art to which this disclosure belongs.

FIG. 1 illustrates a perspective view of a sewing system 100 including a sewing machine 102, an embroidery machine 104, and workpiece holder 106 for embroidering in accordance with embodiments of the present disclosure. Referring to FIG. 1, the sewing machine 102 includes a vertically-mounted needle 108 for sewing fabric or another sewing workpiece (not shown). Example sewing workpieces include, but are not limited to, any suitable fabric, felt, wool, or the like. Such workpieces can generally be planar in shape and flexible. The needle 108 can move upward and downward along a vertical direction for sewing together material as will be understood by those of skill in the art. The sewing machine 102 include a work area, generally designated 110, that is positioned beneath an upper portion or head 112 of the sewing machine 102.

The embroidery machine 104 can be operably attached to the sewing machine 102 for use in embroidering fabric or other sewing workpiece. The embroidery machine 104 includes a base 114 that can be attached to a base 116 of the sewing machine 102. The embroidery machine 104 includes a mechanism 118 that can move the workpiece holder 106 in accordance with programmed instructions for cooperatively operating with the sewing machine 102 to embroider the fabric. In this example, the mechanism 118 can move the workpiece holder 106 along directions that are at a right angle from the upward direction while the needle 108 is moved to embroider a programmed pattern or design on the fabric held by the workpiece holder 106.

With continuing reference to FIG. 1, the workpiece holder 106 includes an outer frame 120 and an inner frame 122 that can be attached together for holding the fabric. When attached together as shown in the figure, the frames 120 and 122 can define an opening, generally designated 124, within which a portion of the fabric is exposed for embroidering by the needle 108. The frames 120 and 122 can define a perimeter around the exposed portion of the fabric for holding the fabric's edges and applying tension during the embroidery process.

The workpiece holder 106 can include brackets 126 and 128 that are attached to opposing sides of the workpiece holder 106. Brackets 126 and 128 are positioned to extend from an outside periphery of the inner frame 122 and the outer frame 120, respectively, to avoid interference with the embroidery process by the needle 108 on the exposed portion of the fabric within the opening 124. Bracket 126 is attached to the inner frame 122. Bracket 128 is attached to the outer frame 120. It should be understood that in the alternative the brackets may be suitably attached to the same frame (i.e., one of the inner or outer frames). In the depicted orientation of the workpiece holder 106, the bracket 126 is operatively attached to the mechanism 118 of the embroidery machine 104. Also, in this orientation, one side of the fabric faces or is directed upward towards the needle 108 for embroidery on that side of the fabric. The bracket 126 is attached to the outer frame 120 in this example. In instances in which the other side of the fabric is to be embroidered, the workpiece holder 106 can be re-oriented or flipped such that bracket 128 is operatively attached to the mechanism 118 and the other side of the fabric faces or is directed upward towards the needle 108 for embroidery on that side of the fabric. In this way, an operator can conveniently embroider both side of the fabric in turn without releasing the fabric from its attachment to the workpiece holder 106. This can improved efficiency and reduce the likelihood that the fabric will be misaligned for embroidery when changing from one side to the other.

The workpiece holder 106 can include a clamp 130 for attaching the outer frame 120 to the inner frame 122. Particularly, the outer frame 120 can be flexible such that it can its periphery can fit around the inner frame 122 with the fabric being placed therebetween for hold. The clamp 130 can include a thumb screw 132 that is operable to tightened the outer frame 120 to the inner frame 122 and for securely compressing the fabric therebetween.

FIG. 2 illustrates a top view of the inner frame 122 of the workpiece holder 106 shown in FIG. 1. Referring to FIG. 2, the bracket 126 defines features 200 and 202 for attaching to the mechanism of the embroidery machine (e.g., mechanism 118 shown in FIG. 1). The inner frame 122 defines an opening 204 that can align with a corresponding opening of the outer frame when the inner and outer frames are attached as shown in FIG. 1. These openings, when the inner and outer frames are attached, can form the aligned opening 124 shown in FIG. 1. When fabric or other sewing workpiece is attached, can have an exposed portion through the opening.

With continuing reference to FIG. 2, bracket 126 defines features, generally designated 206, that are coded with information for a sewing embroidery machine, such as the embroidery machine 104 shown in FIG. 1. In accordance with embodiments, the features 206 are configured to interface with the sewing embroidery machine for sensing or other detection by the sewing embroidery machine for indicating to the sewing embroidery machine when the bracket 126 is attached to the sewing embroidery machine. In this example, the features 206 include multiple protrusions that extend from the bracket 126, but it should be recognized that there may be any number of features 206 having any suitable shape, position, and/or size that are detectable by the sewing embroidery machine for indicating indicate information for the sewing embroidery machine to identify a size and/or type of the frame assembly. As a result of being informed of the size and/or type of the frame assembly, the sewing embroidery machine can use this information for controlling movement of a workpiece holder (e.g., workpiece holder 106) in accordance with programmed instructions for cooperatively operating with the sewing machine 102 to embroider the fabric.

In accordance with embodiments, features 206 can indicate information for the sewing embroidery machine to identify a side of the sewing workpiece positioned towards a working part of a sewing machine. For example, when the bracket 126 is connected to the embroidery machine, the embroidery machine can determine which side of a sewing workpiece is facing the needle 108 so that it can subsequently embroidery a particular part of an embroidery design on the facing side in accordance with its programming.

In the example of FIG. 2, features 206 are shown on bracket 126 for use by the embroidery machine as described. Although, it is noted that bracket 128 may include similar features for providing information to the embroidery machine which the bracket 128 is attached thereto. For example, such features on the bracket 128 can indicate a side of the sewing workpiece positioned towards a working part of a sewing machine. Further for example, such features on the bracket 128 can indicate a size and/or a type of the frame assembly.

The embroidery machine (indicated by reference 104 in FIG. 1 for example) can include an interface (not shown) for reading or interpreting the information or data of features 206. For example, the interface of the embroidery unit of the embroidery machine can include one or more subparts that can be engaged when the bracket 126 is properly attached to the sewing embroidery machine. Further, the embroidery machine can include one or more electrical switches that are operably connected to the subparts. The electrical switches may be activated or inactivated by corresponding features 206. One or more of the switches may be actuated by the identification elements according to a predetermined order when the bracket is attached. In that way, the interface may determine the type and/or size of the frame assembly and communicate this to the sewing machine when setting up a new embroidery. In an example, there are 6-7 such electrical switches that each be activated or inactivated. In the same way, each switch may either activate or inactivate by being sufficiently pressed or released according to a predetermined order by the identification elements. In examples, the subparts may be spring loaded. The spring may thus be biased during engagement with the bracket. The bias may thus be released when detached and spring back to help disengagement of the bracket.

FIG. 3 illustrates a top view of the outer frame 120 of the workpiece holder 106 shown in FIG. 1. Referring to FIG. 3, the bracket 128 is configured to attach the mechanism of the embroidery machine (e.g., mechanism 118 shown in FIG. 1). The outer frame 120 defines an opening 300 that can align with a corresponding opening of the inner frame when the inner and outer frames are attached as shown in FIG. 1. These openings, when the inner and outer frames are attached, can form the aligned opening 124 shown in FIG. 1. When fabric or other sewing workpiece is attached, can have an exposed portion through the opening.

With continuing reference to FIG. 3, the outer frame 120 includes the clamp 130 for attaching the outer frame 120 to the inner frame. The thumb screw 132 may operatively engage a levered mechanism 302 for closing and thereby tightening a gap 304 to secure the flexible outer frame 120 about the inner frame. Fabric or other material may be suitably placed between the frames and then secured when the thumb screw 132 and mechanism 302 operably cooperate to tighten the outer frame 120 about the inner frame.

FIG. 4 illustrates a top view of the outer frame 120 and the inner frame 122 attached together in accordance with embodiments of the present disclosure. Referring to FIG. 4, the frames 120 and 122 form the opening 126 when attached. It is noted that for these embodiments the brackets interface the mechanism of the embroidery machine from opposing directions and on different sides of the frame assembly of frames 120 and 122. In this way, when one is switching to a different side of fabric for embroidery, the frame assembly with attached fabric is easily flipped to a different orientation of operation without the need to release the fabric from the frame assembly.

FIG. 5 illustrates a top view of the outer frame 120 and the inner frame 122 along with an arrow 500 depicting the motion needed to move the frame assembly one bracket 128 is detached and subsequently the bracket 126 is attached to the mechanism of the embroidery machine. This is the movement from the orientation shown in FIG. 4 to the orientation shown in FIG. 6, which illustrates an opposing view of the view of the outer frame 120 and the inner frame 122 shown in FIG. 4. As shown in FIG. 6, the outer frame's 120 bracket 128 also includes features 600 and 602 for engaging the mechanism of the embroidery machine similar to the bracket 126.

FIG. 7 illustrates a close, perspective view of the outer frame 120 and the inner frame 122. Referring to FIG. 7, the outer frame 120 defines an indentation, generally designated 700, that is located adjacent to the bracket 126 of the inner frame 122 when the frames 120 and 122 are attached such that a portion of fabric or other sewing workpiece fits in the indentation 700 when the sewing workpiece is being held between the frames 120 and 122. The indentation 700 extends along the outer frame 120 a distance greater than a width of the bracket 126.

FIG. 8 illustrates a side view of the outer frame 120 and the inner frame 122. Referring to FIG. 8, arrow 800 indicates an upward direction toward a needle of the sewing machine during orientation for operation. The outer frame 120 defines a gap, generally designated 802, on its lower side in this orientation. The gap 802 provides spacing between held fabric and a stitch plate for various embroidery work, such as felting and bobbin work. In this example, the gap 802 is approximately 12 millimeters (mm) as shown, but it should be appreciated by those of skill in the art that the gap may be any other suitable spacing and size.

FIG. 9 illustrates a perspective view of the sewing system 100 shown in FIG. 1 during operation for embroidering fabric 900 in accordance with embodiment of the present disclosure. Referring to FIG. 9, the fabric 900 is positioned below the needle 108 for embroidering a design 902 on the top side 904 of the fabric 900. The embroidery machine 104 can store a plan of the design 902 in its memory and operate to embroider the design 902 by operating together with the sewing machine 102. The mechanism 118 can be controlled to move the workpiece holder 106 in accordance with the plan of the design 902.

With continuing reference to FIG. 9, in some design plans work by the needle 108 may be required on both sides of material. In such instances, workpiece holder 106 may be flipped to attach to its other bracket (i.e., the other of the two brackets 126 and 128 shown in FIG. 1) for work to be done on the opposing side. In the example shown in FIG. 9, the workpiece holder 106 may be flipped such that the side of the fabric 900 that opposes side 904 faces the needle 108 on the opposing side in accordance with the stored design plan.

As will be recognized by those of skill in the art, a sewing embroidery machine, such as embroidery machine 104 shown in FIG. 1, can include suitable electronics and programming for moving a workpiece holder in accordance with programmed instructions for cooperatively operating with an operably attached sewing machine, such as sewing machine 102, to embroider fabric or other material. For example, the embroidery machine 104 can include hardware, firmware, and/or software for implementing such programmed instructions. In accordance with embodiments, embroidery machine 104 may include suitable mechanics for detecting features on an attached bracket that indicate when the bracket 126 is attached to the sewing embroidery machine. The features can also indicate to the embroidery machine a side of the sewing workpiece positioned towards a working part of a sewing machine. Further, the features can indicate a size and/or a type of the frame assembly. Suitable components and/or electronics of the embroidery machine can interpret the size, shape, and/or positioning of the features for becoming informed of this information.

FIG. 10 illustrates a flow diagram of an example method of use of features of a frame assembly bracket by a sewing embroidery machine in accordance with embodiments of the present disclosure. It is noted that the method is described by example as being implemented by the sewing system 100 shown in FIG. 1, but it should be recognized that it may be implemented by any other suitable sewing system. More particularly, the method is described as being implemented by hardware, software, firmware, other components, or combinations thereof of the embroidery machine 104 that is operable to implement embroidery functions and to recognize the information features on a bracket, such as features 206 shown in FIG. 2.

Now turning to FIG. 10, the method includes detecting 1000 information encoded in features of a frame assembly bracket. For example, bracket 126 shown in FIG. 1 can be operably attached to the embroidery machine 104. When operably attached, the embroidery machine 104 can detect or recognize the shape, position, and/or size of features 206, which provide information about a side of a sewing workpiece positioned towards a working part (e.g., a needle) of a sewing machine. For example, the information can be used by the embroidery machine 104 to recognize that a top side 904 of the fabric 900 shown in FIG. 9 is facing upward towards the needle 108. Also, the information can be used by the embroidery machine 104 to determine a size and/or type of the attached frame assembly.

The method of FIG. 10 includes controlling 1002, based on the detected information, movement of a workpiece holder in accordance with programmed instructions for cooperatively operating with a sewing machine 102 to embroider material. Continuing the aforementioned example, the embroidery machine 104 can use the detected information to control movement of the workpiece holder 106 in accordance with programmed instructions for cooperatively operating with the sewing machine 102 to embroider fabric (e.g., fabric 900 shown in FIG. 9).

Subsequent to embroidering on a side of material, the operator can re-orient or flip the workpiece holder to attach the other bracket as described herein. For example, the workpiece holder may initially be attached by bracket 126 and subsequently attached by bracket 128 once work on one side of the material is complete. The method of FIG. 10 includes a step of detecting 1004 information encoded in features of another bracket of the frame assembly. For example, the embroidery machine 104 can detect features on bracket 128 that indicate its attachment. Thereby, the embroidery machine 104 can determine that the other side of the material is facing the material based on detection of the features on the bracket 128.

Subsequently, the method of FIG. 10 includes controlling 1006, based on the detected information of the features of the other bracket, movement of a workpiece holder in accordance with programmed instructions for cooperatively operating with a sewing machine to embroider material. Continuing the aforementioned example, the embroidery machine 104 can use the detected information to control movement of the workpiece holder 106 in accordance with programmed instructions for cooperatively operating with the sewing machine 102 to embroider fabric 900 shown in FIG. 9 on the other side.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A sewing workpiece holder for a sewing embroidery machine, the sewing workpiece holder comprising:

a first frame that defines an opening;

a second frame that defines an opening, wherein the second frame is configured to attach to the first frame and to hold a sewing workpiece therebetween, wherein the openings of the first frame and the second frame substantially align when the second frame is attached to the first frame such that a portion of the sewing workpiece is exposed within the aligned openings when the sewing workpiece is held;

a first bracket attached to a first side of the first frame, the first bracket being attachable to the sewing embroidery machine; and a second bracket attached to a second side of the second frame, the second bracket being attachable to the sewing embroidery machine.

2. The sewing workpiece holder of claim 1, wherein the sewing workpiece comprises fabric, felt, or wool.

3. The sewing workpiece holder of claim 1, wherein the first frame and the second frame are substantially rectangular in shape.

4. The sewing workpiece holder of claim 1, wherein the first bracket and the second bracket are releasably attachable to the sewing embroidery machine.

5. The sewing workpiece holder of claim 1, wherein the first bracket is attachable to the sewing embroidery machine when positioned in a first orientation, and wherein the second bracket is attachable to the sewing embroidery machine when positioned in a second orientation that is different than the first orientation.

6. The sewing workpiece holder of claim 5, wherein in the first orientation, a first side of the sewing workpiece is directed in a direction towards a working part of a sewing machine attached to the sewing embroidery machine, and wherein in the second orientation, a second side of the sewing workpiece is directed in the direction towards the working part of the sewing machine.

7. The sewing workpiece holder of claim 6, wherein the direction is substantially upward.

8. The sewing workpiece holder of claim 6, wherein the working part of the sewing machine is a sewing needle.

9. The sewing workpiece holder of claim 1, wherein the first side of the first frame or the second frame substantially opposes the second side of the first frame or the second frame.

10. The sewing workpiece holder of claim 1, wherein the first frame and second frame extend along a horizontal plane when attached, and wherein the first bracket and the second bracket are mutually arranged in opposing directions relative to the horizontal plane.

11. The sewing workpiece holder of claim 1, further comprising a clamp for attaching the first frame to the second frame.

12. The sewing workpiece holder of claim 1, wherein the first bracket is attached to the first side of the first frame, and wherein the second frame defines an indentation that is located adjacent to the first bracket when the first and second frames are attached such that a portion of the sewing workpiece fits in the indentation when the sewing workpiece is being held between the first frame and the second frame.

13. The sewing workpiece holder of claim 12, wherein the indentation extends along the second frame a distance greater than a width of the first bracket.

14. A sewing system comprising:

a sewing machine including a working part for sewing a workpiece;

a sewing embroidery machine attached to the sewing machine for cooperatively operating with the sewing machine to embroider the workpiece; and a workpiece holder comprising:

a first frame that defines an opening;

a second frame that defines an opening, wherein the second frame is configured to attach to the first frame and to hold the workpiece therebetween, wherein the openings of the first frame and the second frame substantially align when the second frame is attached to the first frame such that a portion of the sewing workpiece is exposed for embroidery within the aligned openings when the workpiece is held;

a first bracket attached to a first side of the first frame, the first bracket being attachable to the sewing embroidery machine; and a second bracket attached to a second side of the second frame, the second bracket being attachable to the sewing embroidery machine.

15. A method for embroidery comprising:

placing a sewing workpiece between a first frame and a second frame of a sewing workpiece holder, wherein the first and second frames define an opening when attached together for exposing a portion of the sewing workpiece, wherein the sewing workpiece holder comprises a first bracket and a second bracket, the first bracket being attached to a first side of the first frame, and the second bracket attached to a second side of the second frame;

attaching the first bracket to a sewing embroidery machine for orienting a first side of the sewing workpiece in a direction towards a working part of a sewing machine attached to the sewing embroidery machine;

detaching the first bracket from the sewing embroidery machine; and attaching the second bracket to the sewing embroidery machine for orienting a second side of the sewing workpiece in a direction towards the working part of a sewing machine.

16. The method of claim 15, wherein the first bracket and the second bracket are releasably attachable to the sewing embroidery machine.

17. The method of claim 15, wherein the first bracket is attachable to the sewing embroidery machine when positioned in a first orientation, and wherein the second bracket is attachable to the sewing embroidery machine when positioned in a second orientation that is different than the first orientation.

18. The method of claim 17, wherein in the first orientation, a first side of the sewing workpiece is directed in a direction towards a working part of a sewing machine attached to the sewing embroidery machine, and wherein in the second orientation, a second side of the sewing workpiece is directed in the direction towards the working part of the sewing machine.

19. The method of claim 18, wherein the working part of the sewing machine is a sewing needle.

20. The method of claim 15, wherein the first side of the first frame or the second frame substantially opposes the second side of the first frame or the second frame.

21. A sewing workpiece holder for a sewing embroidery machine, the sewing workpiece holder comprising:

a frame assembly configured to hold a sewing workpiece, wherein the frame assembly defines an opening for exposing a portion of the sewing workpiece when the sewing workpiece is held;

a first bracket attached to a first side of the frame assembly, the first bracket being attachable to the sewing embroidery machine; and a second bracket attached to a second side of the second frame, the second bracket being attachable to the sewing embroidery machine, wherein the second bracket defines at least one feature configured to interface with the sewing embroidery machine and to indicate to the sewing embroidery machine when the second bracket is attached to the sewing embroidery machine.

22. The sewing workpiece holder of claim 21, wherein the at least one feature is shaped, positioned, and/or sized to indicate information for the sewing embroidery machine to identify a size and/or type of the frame assembly.

23. The sewing workpiece holder of claim 21, wherein the at least one feature is shaped, positioned, and/or sized to indicate information for the sewing embroidery machine to identify a side of the sewing workpiece positioned towards a working part of a sewing machine.

24. The sewing workpiece holder of claim 21, wherein the first bracket defines at least one feature configured to interface with the sewing embroidery machine and to indicate to the sewing embroidery machine when the first bracket is attached to the sewing embroidery machine.

25. The sewing workpiece holder of claim 24, wherein the at least one feature of the first bracket is shaped, positioned, and/or sized to indicate information for the sewing embroidery machine to identify a size and/or type of the frame assembly.

26. The sewing workpiece holder of claim 21, wherein the at least one feature of the first bracket is shaped, positioned, and/or sized to indicate information for the sewing embroidery machine to identify a side of the sewing workpiece positioned towards a working part of a sewing machine.

* * * * *